US011293211B2

(12) United States Patent
Tokudome

(10) Patent No.: US 11,293,211 B2
(45) Date of Patent: Apr. 5, 2022

(54) VEHICLE DOOR OPENING AND CLOSING DEVICE

(71) Applicant: U-Shin Ltd., Tokyo (JP)

(72) Inventor: Tetsuo Tokudome, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 0 days.

(21) Appl. No.: 16/771,042

(22) PCT Filed: Dec. 10, 2018

(86) PCT No.: PCT/JP2018/045256
§ 371 (c)(1),
(2) Date: Jun. 9, 2020

(87) PCT Pub. No.: WO2019/117066
PCT Pub. Date: Jun. 20, 2019

(65) Prior Publication Data

US 2021/0180390 A1 Jun. 17, 2021

(30) Foreign Application Priority Data

Dec. 11, 2017 (JP) ..... JP2017-237026

(51) Int. Cl.
*E05F 15/00* (2015.01)
*E05F 15/73* (2015.01)

(52) U.S. Cl.
CPC ..... *E05F 15/73* (2015.01); *E05Y 2201/41* (2013.01); *E05Y 2201/422* (2013.01); *E05Y 2400/858* (2013.01); *E05Y 2900/532* (2013.01)

(58) Field of Classification Search
CPC ..... E05F 15/40; E05F 15/616; E05F 15/73; E05F 15/70; E05Y 2400/302;
(Continued)

(56) References Cited

U.S. PATENT DOCUMENTS 7,547,058 B2 * 6/2009 King ..... B60J 5/101 296/146.8
8,284,022 B2 * 10/2012 Kachouh ..... G07C 9/00309 340/5.72

(Continued)

FOREIGN PATENT DOCUMENTS

JP 2016-500775 1/2016
JP 2016-166463 9/2016

(Continued)

OTHER PUBLICATIONS

International Search Report dated Jan. 29, 2019 in International (PCT) Application No. PCT/JP2018/045256.

*Primary Examiner* — Chi Q Nguyen
(74) *Attorney, Agent, or Firm* — Wenderoth, Lind & Ponack, L.L.P.

(57) ABSTRACT

A vehicle door opening and closing device includes: a detection unit having three or more detection sections configured to detect an object, wherein each of the detection sections has a detection range for the object, and two or more operation zones are defined by partial overlapping of the detection ranges of the detection sections which are adjacent to each other; and a control section configured to cause a door driving section to control a door to open and close when a predetermined movement performed by the object is detected in any of the two or more operation zones. The control section is configured to use detection results of two of the detection sections corresponding to the operation zone where the object has first been detected for detection of movement of the object in preference to other detection results.

4 Claims, 18 Drawing Sheets

(58) Field of Classification Search
CPC ..... E05Y 2201/23; E05Y 2900/532; E05Y 2201/21; E05Y 2900/548; E05Y 2400/36; E05Y 2201/434; E05Y 2900/546; E05Y 2201/41; E05Y 2400/858; E05Y 2201/422
USPC ..... 49/31
See application file for complete search history.

(56) References Cited

U.S. PATENT DOCUMENTS

| | | | | |
|---|---|---|---|---|
| 8,397,854 | B1 * | 3/2013 | Nam | B62K 25/283 180/213 |
| 8,511,739 | B2 * | 8/2013 | Brown | E05F 15/605 296/146.12 |
| 9,388,623 | B2 * | 7/2016 | Ette | E05F 15/76 |
| 2007/0205863 | A1 * | 9/2007 | Eberhard | B60R 25/2054 340/5.72 |
| 2012/0158253 | A1 * | 6/2012 | Kroemke | B60R 25/246 701/49 |
| 2015/0009062 | A1 * | 1/2015 | Herthan | G01S 7/415 342/70 |
| 2015/0258962 | A1 | 9/2015 | Khanu | |
| 2016/0265263 | A1 | 9/2016 | Motoki et al. | |
| 2017/0114586 | A1 * | 4/2017 | Tokudome | B60R 25/2036 |
| 2018/0030771 | A1 * | 2/2018 | Washeleski | E05F 15/40 |
| 2018/0170309 | A1 * | 6/2018 | McMahon | B60R 25/245 |
| 2020/0291706 | A1 * | 9/2020 | Kimura | E05F 15/43 |
| 2020/0340286 | A1 * | 10/2020 | Tokudome | E05F 15/73 |

FOREIGN PATENT DOCUMENTS

| | | |
|---|---|---|
| JP | 2017-82390 | 5/2017 |
| JP | 2017-172126 | 9/2017 |

* cited by examiner

VEHICLE DOOR OPENING AND CLOSING DEVICE

CROSS-REFERENCE TO RELATED APPLICATIONS

This is a national phase application in the United States of International Patent Application No. PCT/JP2018/045256 with an international filing date of Dec. 12, 2018, which claims priorities of Japanese Patent Application 2017-237026 filed on Dec. 11, 2017 the contents of which are incorporated herewith by reference.

TECHNICAL FIELD

The present invention relates to a vehicle door opening and closing device.

BACKGROUND ART

A door opening and closing device capable of automatically performing opening and closing of a door for which a user does not touch a door handle is known. With the door opening and closing device disclosed in JP 2017-82390 A, the door is opened or closed when the user makes a predetermined movement in an operation zone where detection ranges of two ultrasonic sensors are partially overlapped.

SUMMARY OF THE INVENTION

Problems to be Solved by the Invention

The door opening and closing device of JP 2017-82390 A requires the use to make a predetermined movement in a limited operation zone, and hence there is room for improvement in user convenience.

An object of the present invention is to provide a vehicle door opening and closing device capable of opening and closing the door when the user makes a predetermined movement at a position around the door where the movement is easy.

Means for Solving the Problems

According to an aspect of the present invention, there is provided a vehicle door opening and closing device, including: a door driving section that drives a door to open and close with respect to a vehicle body; a detection unit having three or more detection sections that detect a detected object around the door, wherein each of the detection sections has a detection range for the detected object, the detection sections are arranged on the vehicle body at intervals in a width direction of the door, and two or more operation zones are formed by partial overlapping of the detection ranges of the detection sections adjacent to each other; and a control section that causes the door driving section to control the door to open and close when a predetermined movement performed by the detected object is detected in any of the two or more operation zones on a basis of a change in distance obtained from detection results of the detection sections, wherein the control section uses detection results of two of the detection sections corresponding to the operation zone where the detected object has been first detected of the two or more operation zones, for detection of movement of the detected object in preference to detection results of other the detection sections.

According to the vehicle door opening and closing device, the user can make a movement of driving the door at a position where movement is easy of two or more operation zones formed by the detection ranges of the three or more detection sections. For example, in a case where movement is difficult in a specific operation zone due to a water pool or the like, it is only necessary to make a movement of driving the door in another operation zone, and it is hence possible to improve user convenience. Furthermore, in a case where a plurality of detected objects are detected, the control section gives priority to the detected object that has been first detected and ignores other detected objects, and hence a false detection is not made even if a plurality of persons are present near the door. Moreover, as the detection unit having three or more detection sections, a back sonar mounted on a vehicle in recent years can be used, and hence an increase in cost due to mounting of the vehicle door opening and closing device can be suppressed.

In the vehicle door opening and closing device of the present invention, it is only necessary to make a movement of driving the door at a position where movement is easy of two or more operation zones formed by the detection ranges of the three or more detection sections, and it is hence possible to improve user convenience.

MODE FOR CARRYING OUT THE INVENTION

An embodiment of the present invention will be described below with reference to the drawings.

FIGS. 1A to 4 show a vehicle door opening and closing device 10 according to the present embodiment of the present invention mounted on a vehicle 1. As shown in FIGS. 1A to 1D and FIGS. 2A to 2D, when the user makes a predetermined movement behind a hatchback door (hereinafter simply referred to as a door) 4 of the vehicle 1, the door opening and closing device 10 automatically opens and closes the door 4 without requiring the user to use his hand.

Figure 3:
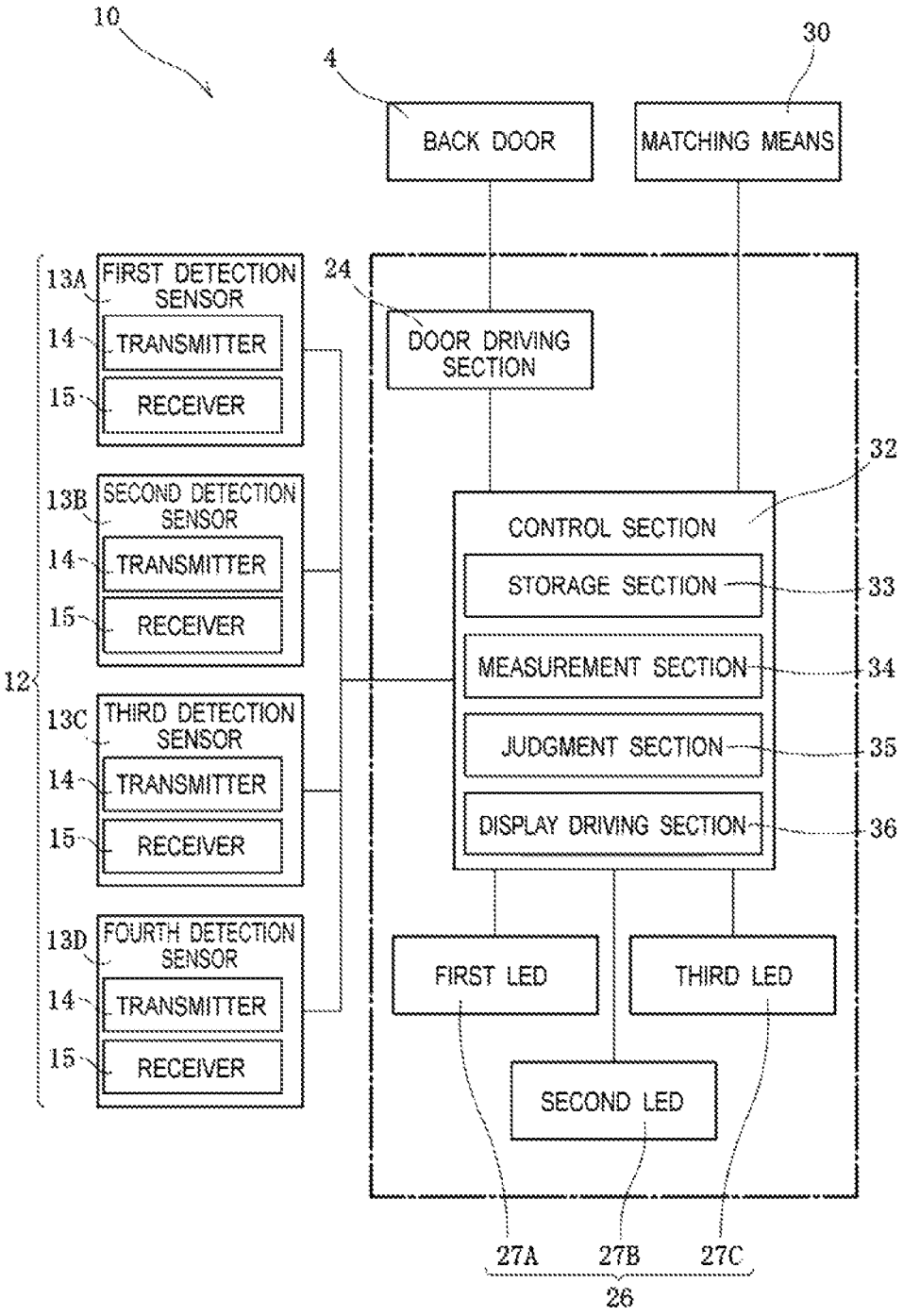
FIG. 3 is a block diagram showing a configuration of the vehicle door opening and closing device.

As shown in FIG. 3, the door opening and closing device 10 includes a detection unit 12, a door driving section 24 (electric equipment of the door 4), a display section 26, a matching means 30, and a control section 32. In FIG. 3, a portion surrounded by a one-dot chain line is a configuration added this time, and existing components mounted on the vehicle 1 are used for the detection unit 12 and the matching means 30. In the vehicle 1 mounted with a remote control type automatic door capable of automatically opening and closing the door 4 by a key (portable machine), the door driving section 24 also uses existing components.

Figure 1A:
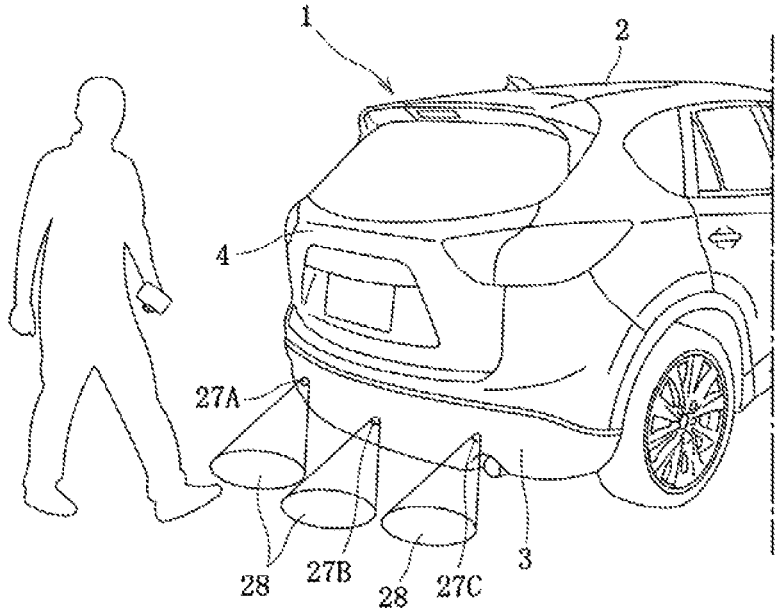
FIG. 1A is a perspective view showing a step of movement for opening a door.
Figure 1B:
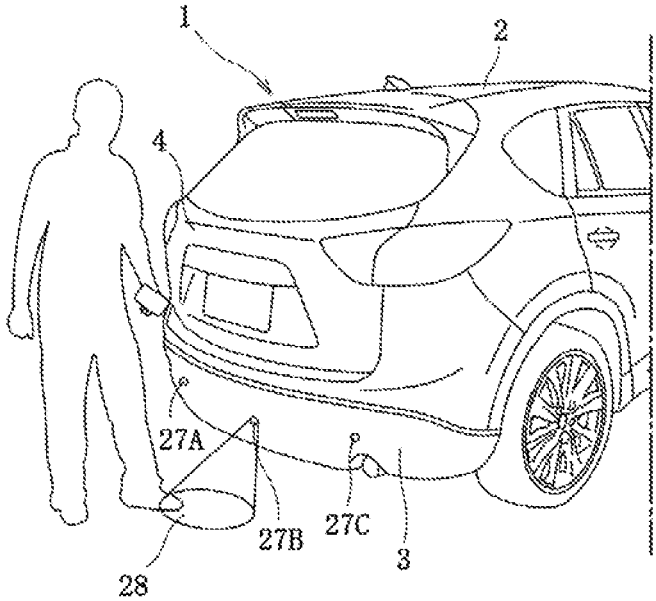
FIG. 1B is a perspective view showing another step of movement for opening the door.
Figure 1C:
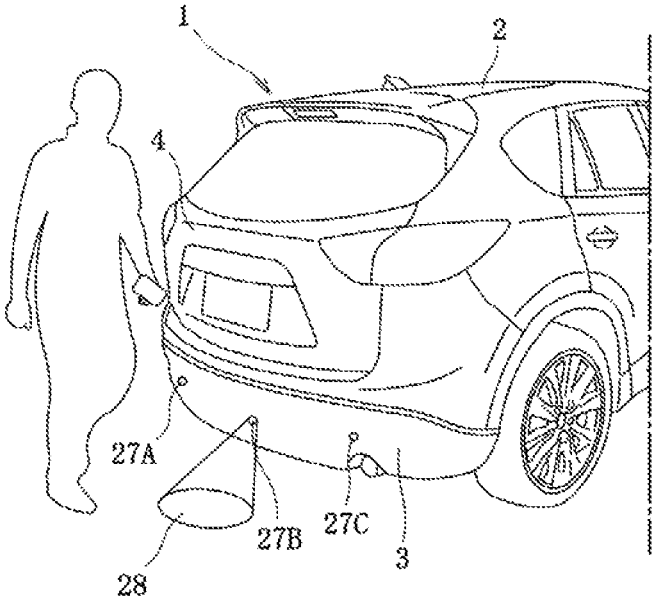
FIG. 1C is a perspective view showing another step of movement for opening the door.
Figure 1D:
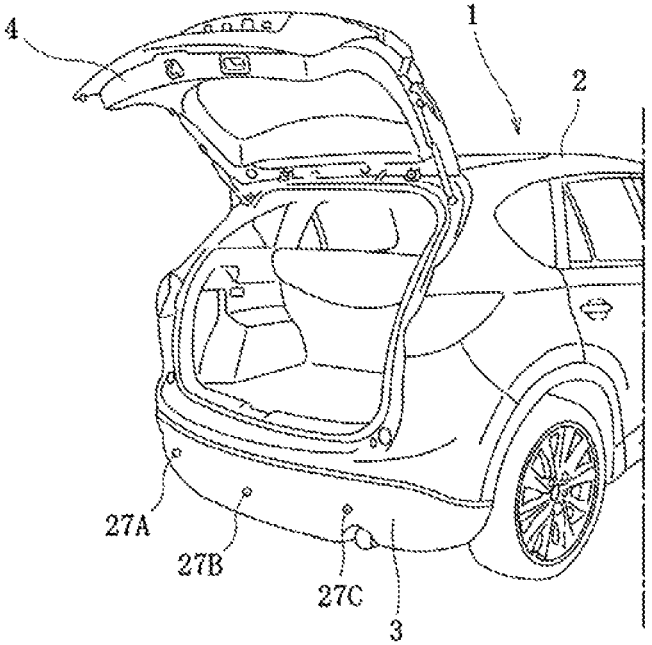
FIG. 1D is a perspective view showing a state where the door is opened.

With the door opening and closing device 10, for example, in a case of opening the door 4 with respect to a vehicle body 2, the user makes the movement shown in FIGS. 1A to 1C. Specifically, the user moves forward so as to approach the door 4 as shown in FIG. 1A, and steps on a display (operation mark) 28 by the display section 26 as shown in FIG. 1B (first action). Subsequently, the user moves backward so as to get away from the door 4 as shown in FIG. 1C (second action). When detecting the predetermined movement on a basis of a change in distance obtained from the detection result of the detection unit 12, the control section 32 causes the door driving section 24 to open the door 4 as shown in FIG. 1D.

Figure 2A:
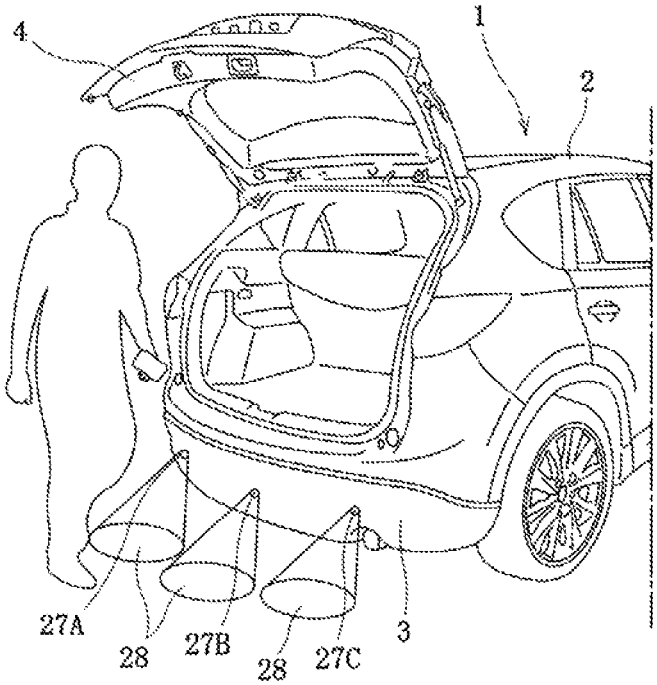
FIG. 2A is a perspective view showing a step of movement for closing the door.
Figure 2B:
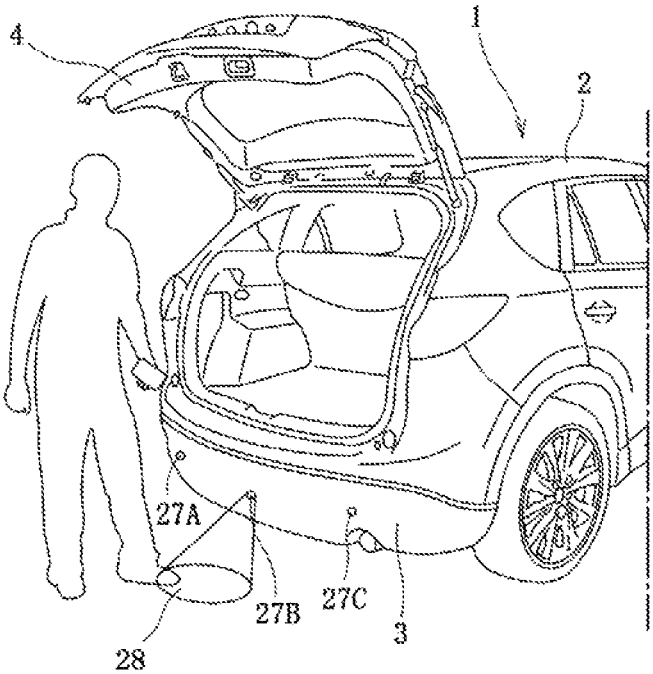
FIG. 2B is a perspective view showing another step of movement for closing the door.
Figure 2C:
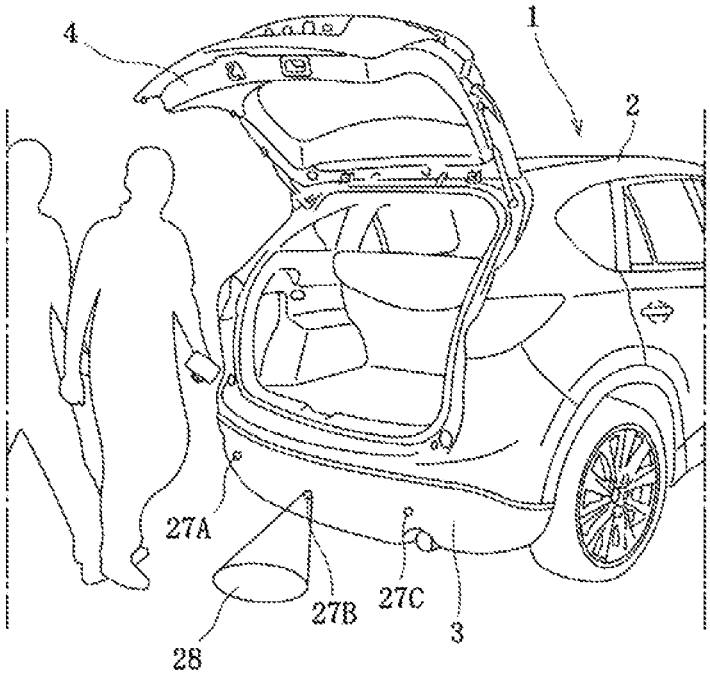
FIG. 2C is a perspective view showing another step of movement for closing the door.
Figure 2D:
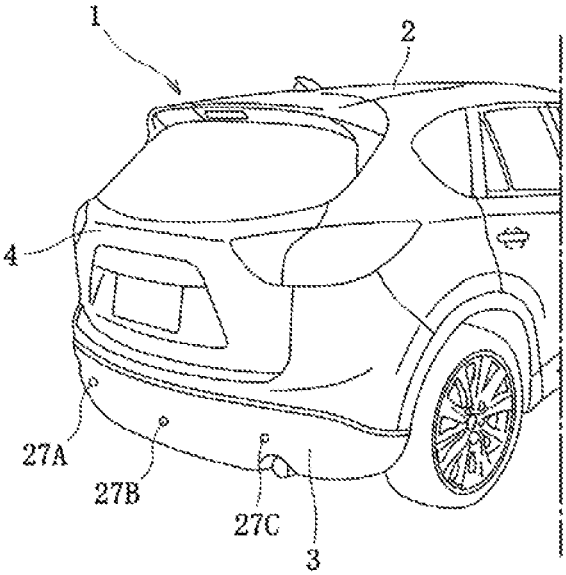
FIG. 2D is a perspective view showing a state where the door is closed.

In a case of closing the door 4 with respect to the vehicle body 2, the user makes the movement shown in FIGS. 2A to 2C. Specifically, the user moves forward so as to approach the door 4 as shown in FIG. 2A, and steps on the display 28 by the display section 26 as shown in FIG. 2B (first action). Subsequently, the user moves backward so as to get away from the door 4 as shown in FIG. 2C (second action), and then moves backward one step further (third action). When detecting the predetermined movement on a basis of a change in distance obtained from the detection result of the detection unit 12, the control section 32 causes the door driving section 24 to close the door 4 as shown in FIG. 2D.

Figure 4:
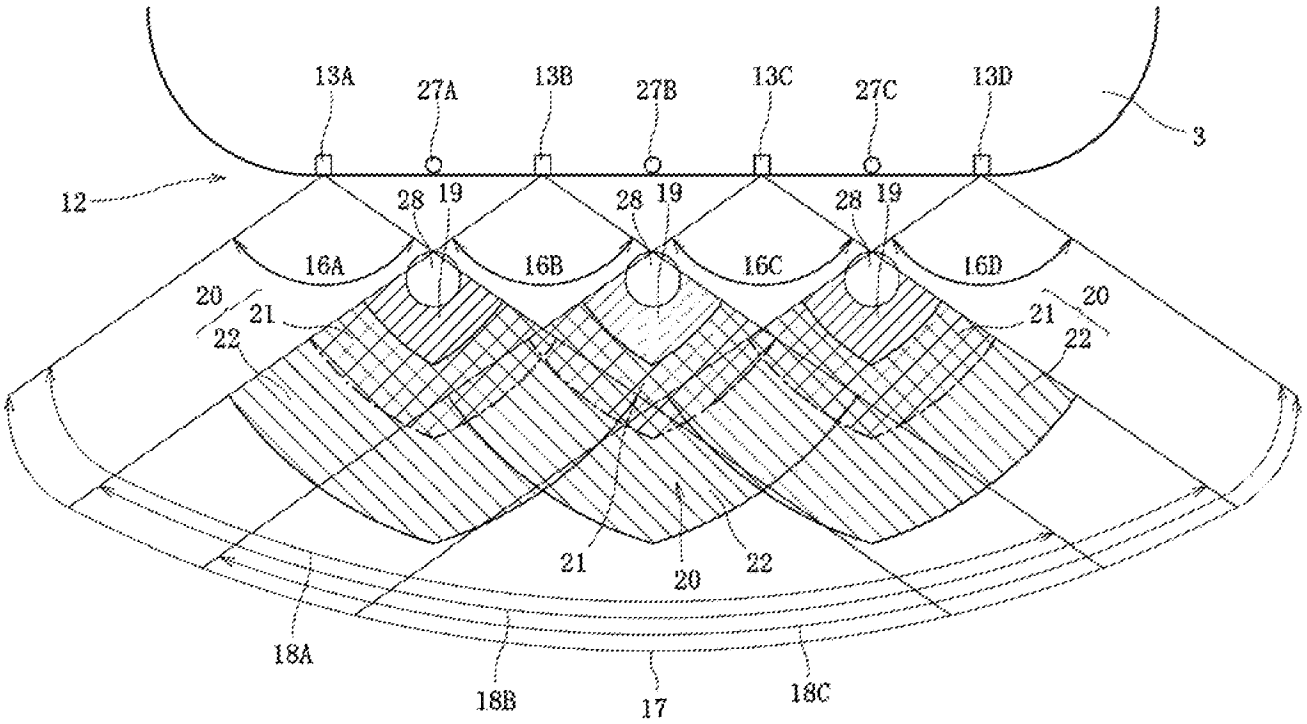
FIG. 4 is a plan view showing a relationship between the detection range, the operation zone, and the display position of the detection unit.

As shown in FIGS. 3 and 4, the detection unit 12 detects a detected object that is located in a predetermined approach region 17. The detected object includes the user, someone other than the user, and an obstacle. The obstacle includes baggage placed around the vehicle, structures (walls and columns) present around the vehicle, and other vehicles parked adjacent to the vehicle.

The detection unit 12 includes a total of four detection sensors (detection sections) 13A to 13D attached to a rear bumper 3 (vehicle body 2) so as to be located at intervals in a vehicle width direction of the door 4. These detection sensors 13A to 13D are also used as ultrasonic sensors used as back sonar sensors. The detection sensors 13A to 13D constituting the back sonar are used for monitoring the rear of the vehicle 1 during traveling. By using these detection sensors 13A to 13D, it is possible to suppress an increase in cost due to mounting the door opening and closing device 10 on the vehicle 1.

The detection sensors 13A to 13D are communicably connected with the control section 32 via a communication cable, and the control section 32 is communicably connected to an electronic control unit (ECU). However, the detection sensors 13A to 13D may be communicably connected with the ECU and the control section 32 may receive detection results of the detection sensors 13A to 13D from the ECU.

The detection sensors 13A to 13D each include a transmitter 14 and a receiver 15. Ultrasonic waves emitted from the transmitter 14 form each detection range 16A to 16D spreading substantially conically toward the rear of the vehicle. On the ground, the detection ranges 16A to 16D spread in a fan shape (for example, the center angle is about 110 degrees). The reflected wave of the ultrasonic wave transmitted from the transmitter 14 is received by the receiver 15. This detection result is used for judgment of the presence or absence of the detected object in the detection ranges 16A to 16D and for calculation of the distance to the detected object.

As shown in FIG. 4, the overall detection ranges 16A to 16D formed by the detection sensors 13A to 13D are the approach region 17. In the approach region 17, three operation zones 18A to 18C where the adjacent detection ranges 16A to 16D partially overlap are formed. The first operation zone 18A is a range (overlap region) in which the detected object is detected by both the first detection sensor 13A and the second detection sensor 13B. The second operation zone 18B is a range in which the detected object is detected by both the second detection sensor 13B and the third detection sensor 13C. The third operation zone 18C is a range in which the detected object is detected by both the third detection sensor 13C and the fourth detection sensor 13D.

The operation zones 18A to 18C are divided into a trigger area 19 and a start area 20 in accordance with a difference in distance from the detection sensors 13A to 13D. The trigger area 19 is set between a first set distance (e.g., 20 cm) and a second set distance (e.g., 50 cm). The start area 20 is set between the second set distance and a third set distance (e.g., 120 cm). The start area 20 is further divided into a first segment 21 and a second segment 22. The first segment 21 is set between the second set distance and a fourth set distance (e.g., 80 cm). The second segment 22 is set between the fourth set distance and the third set distance.

As shown in FIG. 3, the door driving section 24 drives the door 4 to open and close with respect to the vehicle body 2. Although not shown, the door driving section 24 includes a motor capable of rotating the door 4 in the opening direction and the closing direction, a gear mechanism, and a damper. The door driving section 24 is communicably connected with the control section 32 via a communication cable. However, the door driving section 24 may be electrically connected with the ECU, and a driving signal of the door driving section 24 by the control section 32 may be transmitted by the control section 32 to the ECU and transmitted by the ECU to the door driving section 24.

The display section 26 performs optical display that guides the user. The display section 26 includes three LEDs 27A to 27C. With reference to FIG. 3, the first LED 27A illuminates the trigger area 19 of the first operation zone 18A, the second LED 27B illuminates the trigger area 19 of the second operation zone 18B, and the third LED 27C illuminates the trigger area 19 of the third operation zone 18C.

Although not shown in detail, the LEDs 27A to 27C are mounted on a substrate in a casing attached to the rear bumper 3. These substrates are communicably connected with the control section 32 via a communication cable. The light of the LEDs 27A to 27C is collected by a lens, and it is possible to illuminate the ground with illuminance allowing the user to visually recognize not only when the surrounding of the vehicle 1 is dark but also when it is bright.

The matching means 30 includes a receiver-transmitter having an outside-vehicle low frequency (LF) receiving-transmitting antenna performing communication with a key by an LF signal and performing authentication of an outside-vehicle key. The receiver-transmitter is communicably connected with the control section 32 via a communication cable, but it may be communicably connected with the ECU. The receiver-transmitter starts in response to a command from the ECU and performs communication related to key authentication processing. In the key authentication processing, the matching means 30 makes a transmission request of an authentication code to the key, compares the authentication code received from the key with a registered regular code, and, if they match (establish), judges that it is the user.

The control section 32 controls the door driving section 24 on the basis of the key authentication by the matching means 30 and the detection result of the detection unit 12. The control section 32 includes a storage section 33, a measurement section 34, a judgment section 35, and a display driving section 36, and is communicably connected with the ECU. The control section 32 includes a single or a plurality of microcomputers and other electronic devices.

The storage section 33 stores a control program, setting data such as thresholds and judgment values used in the control program, a data table for calculating a distance from the detection results of the detection sensors 13A to 13D, and the like. The storage section 33 can store the detection results (distance information measured by the measurement section 34) of the detection sensors 13A to 13D for the number of times having been set (e.g., 10 times).

On the basis of the time (detection result) from when the transmitter 14 transmits the ultrasonic wave to when the receiver 15 receives the reflected wave, the measurement section 34 measures the distance from the detection sensors 13A to 13D to the detected object. That is, the measurement section 34 and the detection sensors 13A to 13D constitute a distance measurement sensor that measures the distance from the detection sensors 13A to 13D to the detected object. The measurement result is stored in the storage section 33 as distance information. If the number of measurement results exceeds the set number of times for which the storage section 33 is capable of storing, the measurement result is erased in order from the oldest.

The position of one detected object is specified by the measurement result (distance information) obtained by the detection results of the pairs of detection sensors 13A and 13B, 13B and 13C, and 13C and 13D. That is, the position of the detected object in the first operation zone 18A is specified by the measurement results of the detection sensors 13A and 13B. In addition, the position of the detected object in the second operation zone 18B is specified by the measurement results of the detection sensors 13B and 13C. In addition, the position of the detected object in the third operation zone 18C is specified by the measurement results of the detection sensors 13C and 13D. It is to be noted that in a case where two or more detected objects are present at different positions in the individual operation zones 18A to 18C, the number of measurement results by the detection sensors 13A to 13D becomes the same as the number of the detected objects.

The judgment section 35 judges the movement of the user on the basis of a change in the distance that is a measurement result (position of the detected object) of the measurement section 34. That is, on the basis of the difference (change amount) between the current measurement result and the previous measurement result, the judgment section 35 judges whether the user has moved or stopped. The larger the change amount is, the larger the moving distance is, and conversely, the smaller the change amount is, the smaller the moving distance is. The judgment section 35 judges that the user has moved if the change amount exceeds a predetermined judgment value, and judges that the user has stopped if it is equal to or less than the judgment value.

The display driving section 36 individually switches the LEDs 27A to 27C among a lighted state, a blinking state, and a non-lighted state. For example, if the judgment section 35 judges that the user is located in the approach region 17, the display driving section 36 switches all the LEDs 27A to 27C from the non-lighted state to the lighted state (see FIGS. 1A and 2A). If the judgment section 35 judges that the user is located in the start area 20 of any of the operation zones 18A to 18C, the display driving section 36 switches the LED of the corresponding operation zone from the lighted state to the blinking state, and switches the remaining LEDs from the lighted state to the non-lighted state (see FIGS. 1B and 2B). If the judgment section 35 judges that the user has moved from the start area 20 to the trigger area 19, the display driving section 36 switches the LED from the blinking state to the lighted state. In this manner, the user is guided to the trigger area 19 of the predetermined operation zones 18A to 18C.

The automatic opening and closing control of the door 4 by the control section 32 is started when the vehicle 1 is parked and the engine is stopped. The control section 32 causes the door driving section 24 to open or close the door 4 when the key authentication by the matching means 30 is established and the judgment section 35 judges (the control section 32 detects) that the user has made a predetermined movement in any of the three or more operation zones 18A to 18C. The judgment of the movement of the user by the judgment section 35 is performed on the basis of a change in the distance obtained from the detection results of the detection sensors 13A to 13D.

When detecting the movement of the user, the control section 32 uses the detection results of the two detection sensors corresponding to the operation zone where the detected object has been first detected of the three operation zones 18A to 18C in preference to the detection results of the other two detection sensors. In other words, even in a situation where the detected object is detected in two or all of the three operation zones 18A to 18C, the detection result of the detection sensor corresponding to the operation zone that has been first detected is given priority, and the movement by the user is detected.

As a method for giving priority to the former detection result, the control section 32 stops detection by the latter detection sensor. Stopping of detection means that neither transmission by the transmitter 14 nor reception by the receiver 15 is performed. Thus, the movement of the detected object can be quickly detected by shortening the detection cycle of the detection sensor that is given priority, while preventing false detection by the two detection sensors that are given priority.

For example, in a case where the detected object is detected first in the operation zone 18B of the three operation zones 18A to 18C, the control section 32 causes the two detection sensors 13B and 13C corresponding to the operation zone 18B to perform detection, and stops detection of the two other detection sensors 13A and 13D. In a case where the detected object is detected first in the operation zone 18A of the three operation zones 18A to 18C, the control section 32 causes the two detection sensors 13A and 13B corresponding to the operation zone 18A to perform detection, and stops detection of the two other detection sensors 13C and 13D. In this manner, the control section 32 gives priority to the detection results of the two detection sensors over the detection results of the two other detection sensors, and detects the movement by the user.

The control section 32 as the judgment section 35 also has a function of determining whether or not the detected object having been detected is an obstacle other than a detection target. This obstacle judgment is performed on the basis of a change amount in distance obtained from a detected current detection result D and past (last detection) storage information M stored in the storage section 33. Specifically, the judgment section 35 judges whether the detected object is a detection target object or an obstacle on the basis of whether or not the change amount of the distance is within a threshold T1 (e.g., 2 cm). It is to be noted that the comparison between the detection result D and the storage information M is performed for each of the detection sensors 13A to 13D. In addition, even in a case where two or more detected objects have been detected in one of the operation zones 18A to 18C, it is possible to judge whether or not the detected object is an obstacle by comparing the detection result D one by one with all pieces of the storage information M in the identical one of the operation zones 18A to 18C.

Furthermore, in a case of judging that the detected object having been detected by the two detection sensors given priority is an obstacle, the control section 32 uses the detection results of the two detection sensors corresponding to the operation zone where the detected object has been detected second (next) for detection of the movement of the detected object. In a case of judging that the detected object that has been detected second is also an obstacle, the control section 32 uses the detection results of the two detection sensors corresponding to the operation zone where the detected object has been detected third (next) for detection of the movement of the detected object. The priority order is set when detection is performed in all the detection sensors 13A to 13D such as immediately after initialization (step S1 described later) and immediately after a case where none of detected object has been detected in any of the detection zones 18A to 18C (step S8-7 described later). In addition, the priority order is set in the order of performing detection by each of the detection sensors 13A to 13D in the present embodiment, but it may be set on the basis of the detection result (distance information measured by the measurement section 34) of each of the detection sensors 13A to 13D.

For example, in a case of judging that the detected object in the operation zone 18B that has been detected first is an obstacle, the control section 32 uses in preference the detection results of the two detection sensors 13A and 13B corresponding to the operation zone 18A where the detected object has been detected second. In a case of judging that the detected object in the operation zone 18A that has been detected second is also an obstacle, the control section 32 uses in preference the detection results of the two detection sensors 13C and 13D corresponding to the operation zone 18C where the detected object has been detected third. This suppresses control failure of the door 4 due to detection of the obstacle.

Next, the action of the door opening and closing device 10 will be described with reference to flowcharts shown in FIGS. 5A to 15. It is to be noted that a counter N used in the following description is used for the following counting.

Counter Na: Number of times of judging that it is an obstacle

Counter Nb: Number of times of judging that there is no obstacle

Counter Nc: Number of times of detection of detected object in approach region 17

Counter Nd: Number of times of failure of establishment of authentication processing Counter Ne: Number of times of failing to detect user in start area 20

Counter Nf: Number of times of failing to detect user in trigger area 19

Counter Ng: Number of times of failing to detect user moving backward

Counter Nh: Number of times of failing to detect user moving backward

Counter Ni: Number of times of failing to detect user moving backward again (Main flow)

Figure 5A:
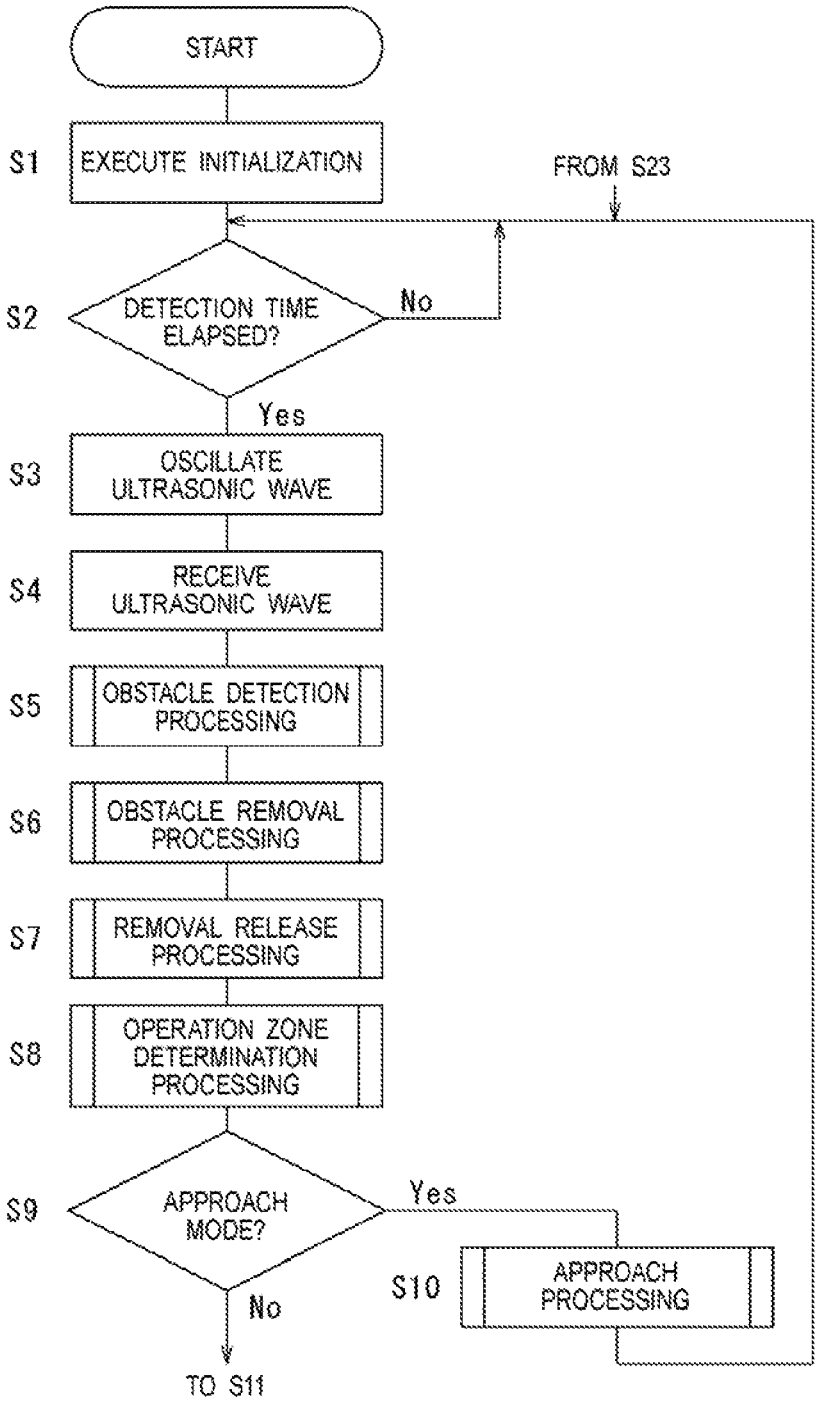
FIG. 5A is a flowchart showing the main control by the control section.
Figure 5B:
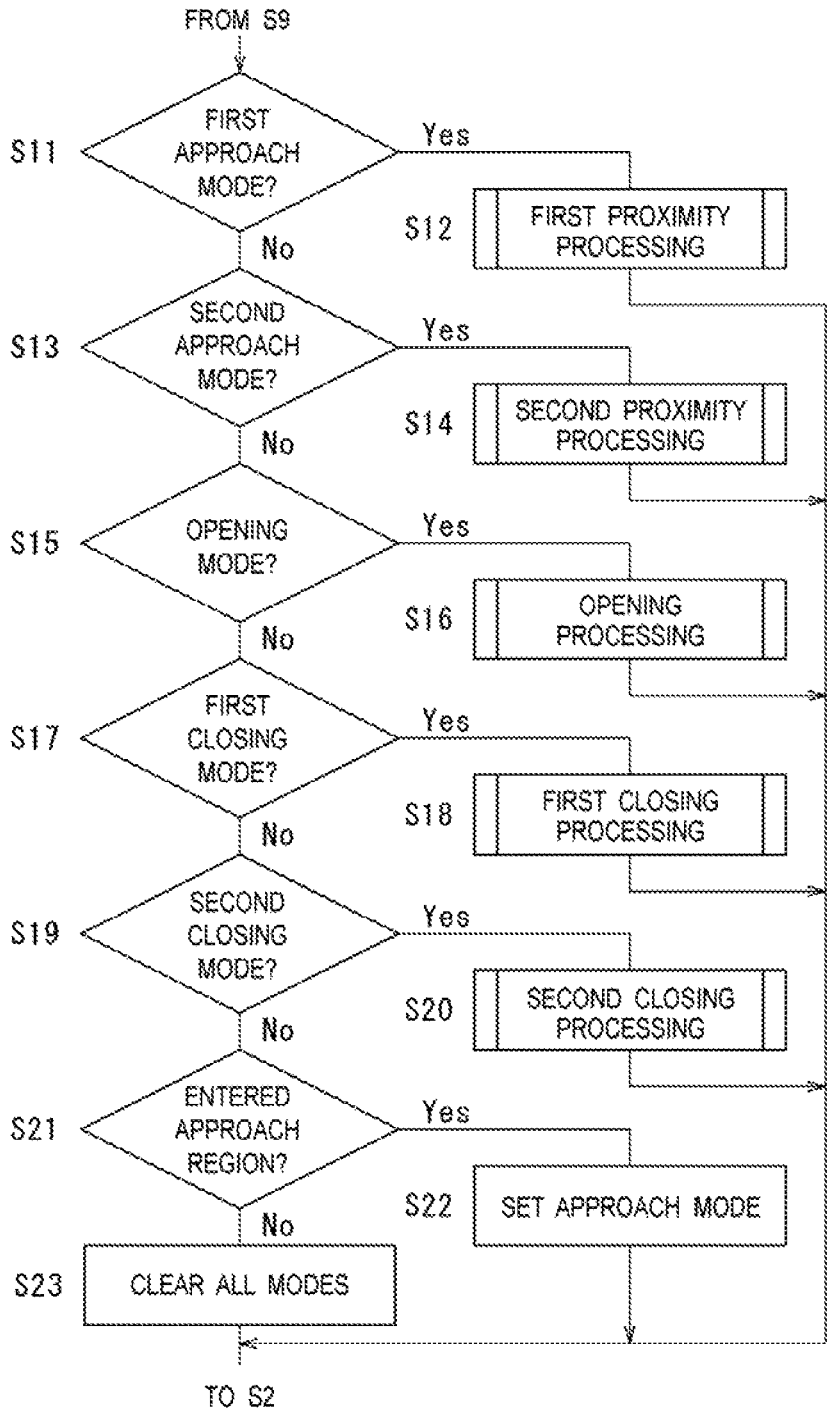
FIG. 5B is a flowchart continued from FIG. 5A.

As shown in FIGS. 5A and 5B, the door opening and closing control by the control section 32 is performed by approach processing (step S10), first proximity processing (step S12), second proximity processing (step S14), opening processing (step S16), first closing processing (step S18), and second closing processing (step S20).

The control section 32 first initializes each data used in the door opening and closing control (step S1), and then waits until a predetermined detection time elapses (step S2). When the detection time has elapsed, an ultrasonic wave is transmitted from the transmitter 14 in the order from the first detection sensor 13A to the fourth detection sensor 13D (step S3), and a reflected wave of the ultrasonic wave is received by the receiver 15 (step S4). However, the transmission and reception are performed by, of the four detection sensors 13A to 13D, only the detection sensor having been set to be driven by the operation zone determination processing in step S8 described later and not performed by the detection sensor having been set to be stopped.

Subsequently, the obstacle detection processing for judging the presence or absence of an obstacle in the detected object having been detected is executed (step S5). Furthermore, the obstacle removal processing for removing the detection result D matching the obstacle information K to give only the data of the detection target object is executed (step S6). Thereafter, the removal release processing for removing specific obstacle information from the obstacle information K having been stored to include (return) it into the detection target object is executed (step S7). Subsequently, the operation zone determination processing for determining the detection target (priority zone) and the priority order of the operation zones 18A to 18C is executed (step S8).

Subsequently, it is judged which of processing is to be executed (steps S9, S11, S13, S15, S17, and S19), and processing corresponding to the corresponding mode is executed as described below (steps S10, S12, S14, S16, S18, and S20). Meanwhile, if the detection distance D of the detected object by the detection sensors 13A to 13D becomes less than a set value (here, set to 120 cm) (step S21), the processing mode is set to an approach mode (step S22). If none of modes is selected and the detected object has not entered the approach region 17, all the modes are cleared (step S23).

(Obstacle Detection Processing: Step S5)

Figure 6:
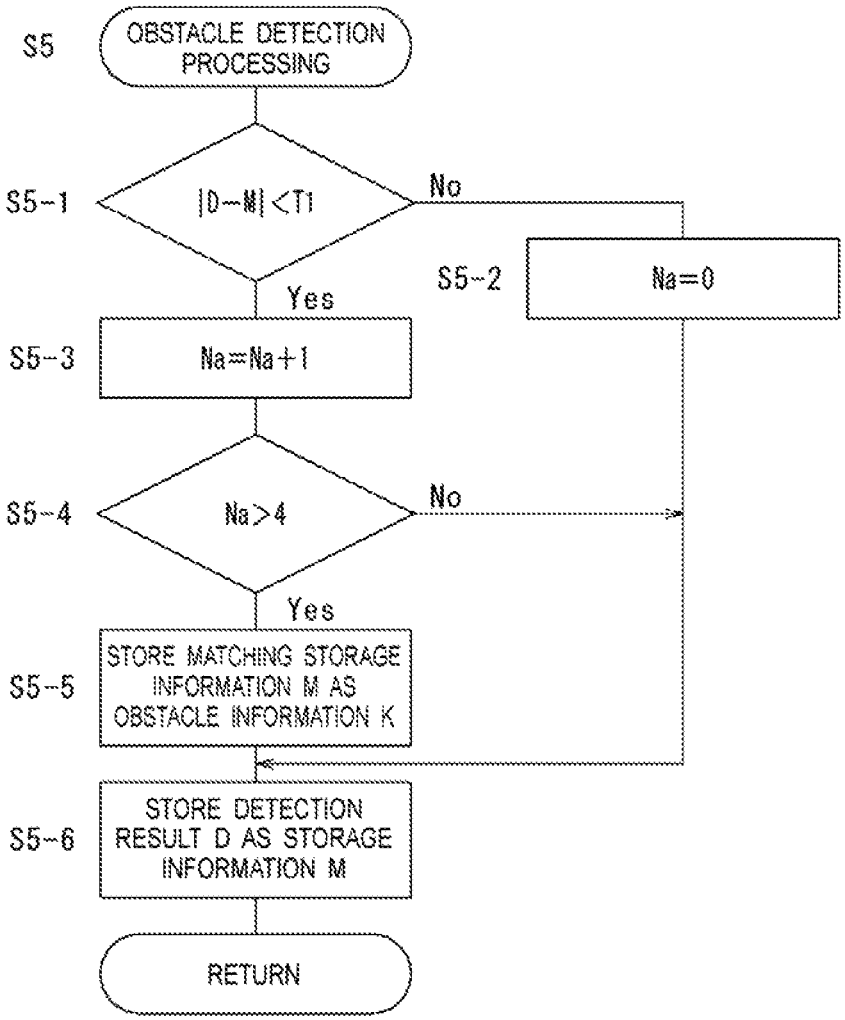
FIG. 6 is a flowchart of obstacle detection processing of FIG. 5A.

As shown in FIG. 6, in the obstacle detection processing, the control section 32 judges whether or not the absolute value (calculation value) of a numerical value obtained by subtracting, from the detection result D, the storage information M detected in the last time is lower than the threshold T1 for each of the detection sensors 13A to 13D (step S5-1).

If the calculation value is equal to or greater than the threshold T1, i.e., if the detected object has moved, the counter Na is cleared (=0) (step S5-2), and the storage information M in the storage section 33 is updated to the detection result D (step S5-6).

If the calculation value is lower than the threshold T1, i.e., if the detected object has not moved, 1 is added to the counter Na (step S5-3). Then, if the counter Na is equal to or less than four times (step S5-4: No), the storage information M of the storage section 33 is updated to the detection result D (step S5-6). If the counter Na exceeds four times (step S5-4: Yes), the storage information M (detection result D) is stored in the storage section 33 as obstacle information K (step S5-5), and the storage information M in the storage section 33 is updated to the detection result D (step S5-6).

(Obstacle removal processing: step S6) In the obstacle removal processing, the control section 32 compares the obstacle information K with all the detection results D for each of the operation zones 18A to 18C, and removes the detection result D substantially matching the obstacle information K.

Figure 7:
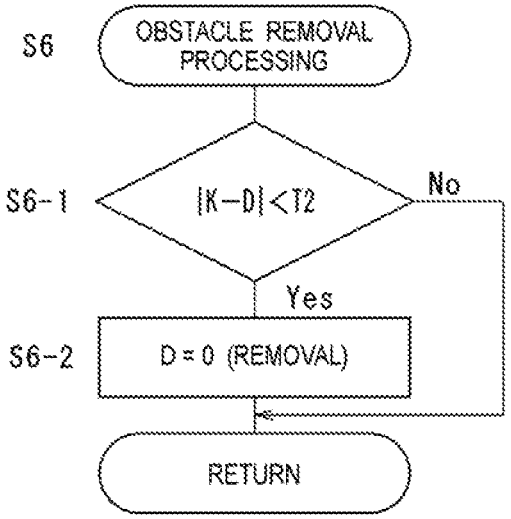
FIG. 7 is a flowchart of obstacle removal processing of FIG. 5A.

Specifically, as shown in FIG. 7, first, it is judged whether or not the absolute value of a numerical value obtained by subtracting the detection result D from the obstacle information K is lower than a threshold T2 (e.g., 2 cm) (step S6-1). If the calculation value is lower than the threshold T2, i.e., if the detected object is an obstacle, the target detection result D is removed (=0) (step S6-2). If the calculation value is equal to or greater than the threshold T2, i.e., if the detected object is not an obstacle, the target detection result D is not removed.

(Removal Release Processing: Step S7)

In the removal release processing, the control section 32 compares the obstacle information K with all the detection results D for each of the operation zones 18A to 18C, and, if there is no detection result D substantially matching the obstacle information K, removes the target obstacle information K and returns to the detection target object.

Figure 8:
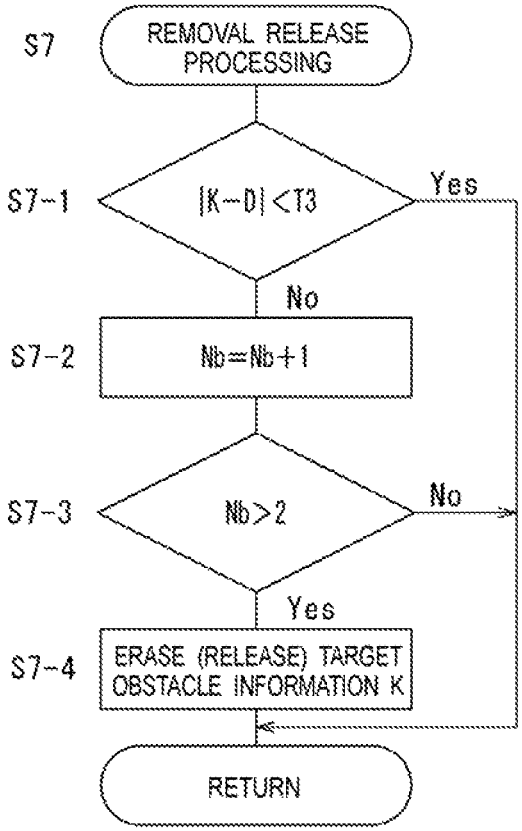
FIG. 8 is a flowchart of removal release processing of FIG. 5A.

Specifically, as shown in FIG. 8, first, it is judged whether or not the absolute value of a numerical value obtained by subtracting the detection result D from the obstacle information K is lower than a threshold T3 (e.g., 2 cm) (step S7-1). If the calculation value is lower than the threshold T3, i.e., if the detection result D and the obstacle information K are substantially identical, removal of the obstacle information K from the storage section 33 is not performed.

If the calculation value is equal to or greater than the threshold T3, i.e., if there is no detection result D matching the obstacle information K, 1 is added to the counter Nb (step S7-2). It is judged whether or not the counter Nb has become more than two times (step S7-3), and if the counter Nb is equal to or less than 2, removal of the obstacle information K from the storage section 33 is not performed. If the counter Nb is greater than 2, the target obstacle information K is erased (removed) from the storage section 33 (step S7-4).

(Operation Zone Determination Processing: Step S8)

In the operation zone determination processing, the control section 32 sets the driving and stopping of the detection sensors 13A to 13D so as to detect only the region (priority zone) where the detected object (user or someone else) has been first detected of the three operation zones 18A to 18C. That is, the priority order of the detection results used for detection of the movement of the detected object, of the detection results by the detection sensors 13A to 13D, is determined in accordance with the order in which the detected object is detected.

Figure 9:
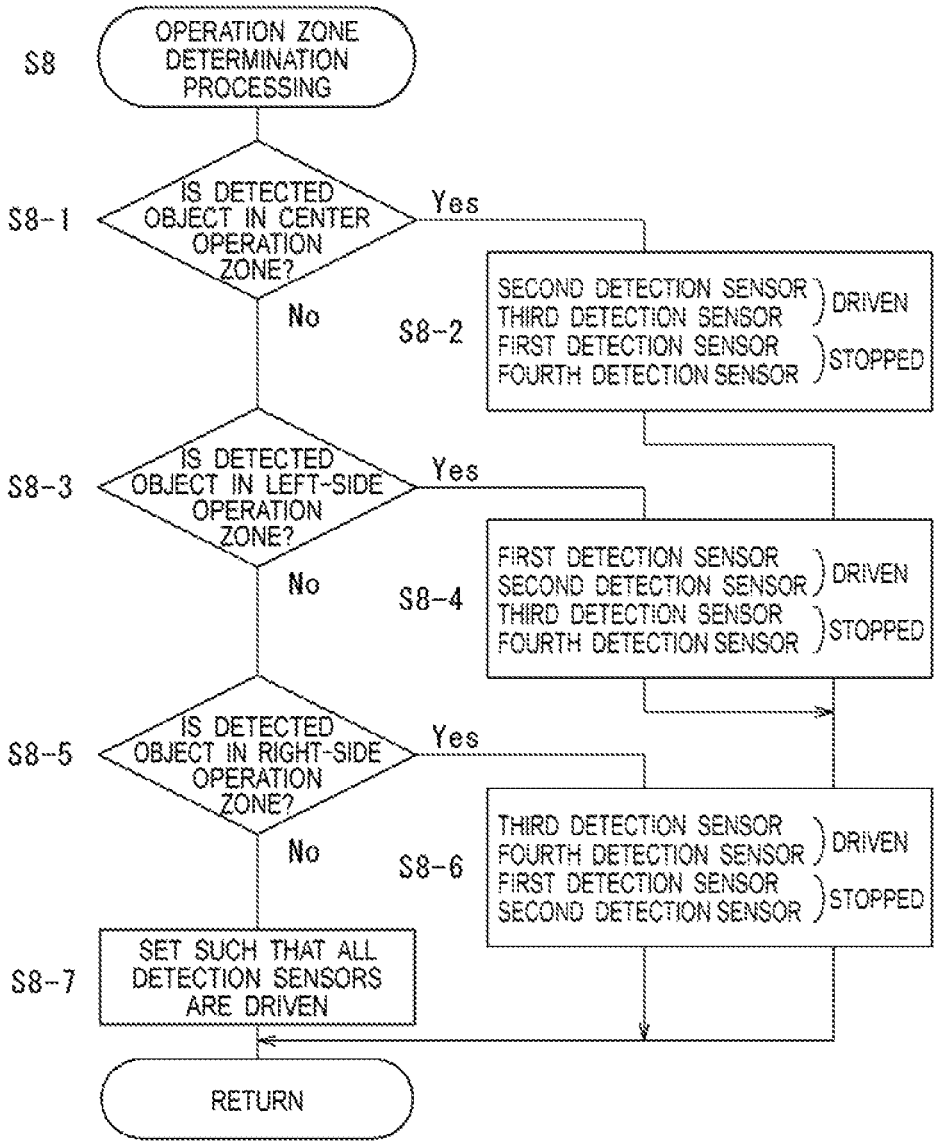
FIG. 9 is a flowchart of operation zone determination processing of FIG. 5A.

Specifically, as shown in FIG. 9, first, if the zone where the detected object has been detected is the center operation zone 18B (step S8-1: Yes), it is set such that the detection sensors 13B and 13C are driven and the detection sensors 13A and 13D are stopped (step S8-2).

If the zone where the detected object has been detected is not the center operation zone 18B (step S8-1: No) but the left-side operation zone 18A (step S8-3: Yes), it is set such that the detection sensors 13A and 13B are driven and the detection sensors 13C and 13D are stopped (step S8-4).

If the zone where the detected object has been detected is not the left-side operation zone 18A (step S8-3: No) but the right-side operation zone 18C (step S8-5: Yes), it is set such that the detection sensors 13C and 13D are driven and the detection sensors 13A and 13B are stopped (step S8-6).

If the zone where the detected object has been detected is not the right-side operation zone 18B (step S8-5: No), i.e., if the detected object has not been detected in any of the operation zones 18A to 18C, it is set such that all the detection sensors 13A to 13D are driven (step S8-7).

By this operation zone determination processing (step S8), in the second proximity processing (step S14), the opening processing (step S16), the first closing processing (step S18), and the second closing processing (step S20), which will be described below, only the detection results of the set pair of detection sensors 13A and 13B, 13B and 13C, or 13C and 13D are processed. In addition, if the detected object in the priority zone is an obstacle, the setting is switched such that only the detection sensors constituting the operation zone with the next priority order are driven, and, if the detected objects in all the operation zones 18A to 18C are obstacles, the priority order is reset.

(Approach Processing: Step S10)

Figure 10:
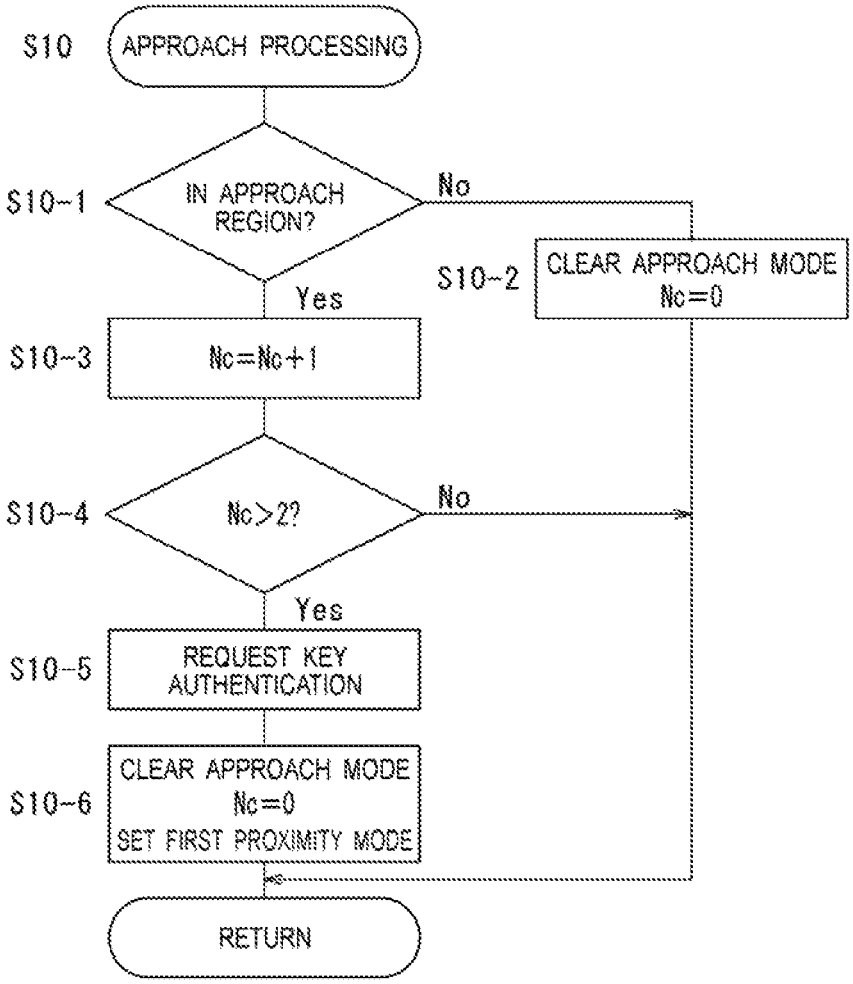
FIG. 10 is a flowchart of approach processing of FIG. 5A.

If the approach mode is set in step S22, the control section 32 executes the approach processing shown in FIG. 10. In the approach processing, the control section 32 judges whether or not the user, which is the detected object, is located in the approach region 17 (step S10-1). If a detection signal is present in any of the detection sensors 13A to 13D, it is judged that the detected object has entered the approach region 17.

If the detected object has not entered the approach region 17 or has moved outside the approach region 17 within a predetermined time even if it has entered (step S10-1: No), the approach mode is cleared and the counter Nc is reset (step S10-2).

If the detected object is located in the approach region 17 (step S10-1: Yes), 1 is added to the counter Nc (step S10-3), and the flow of process waits until the counter Nc exceeds 2 (step S10-4). Then, if it is judged that the detected object is waiting in the approach region 17 for the predetermined time (step S10-4: Yes), key authentication is requested (step S10-5). In this authentication processing, the matching means 17 makes a transmission request of an authentication code with respect to the key, compares the authentication code received from the key with the registered regular code, and, if they match, judges that the detected object is the user. Thereafter, the approach mode is cleared and set to a first proximity mode, thereby changing the processing mode and resetting the counter Nc (step S10-6).

Thus, in the approach processing, the user is located in the approach region 17 of a wide range having been set in advance, thereby performing the authentication processing. This allows the key authentication processing to be completed in advance before executing a specific action when the user causes the door 4 to automatically open and close.

(First Proximity Processing: Step S12)

Figure 11:
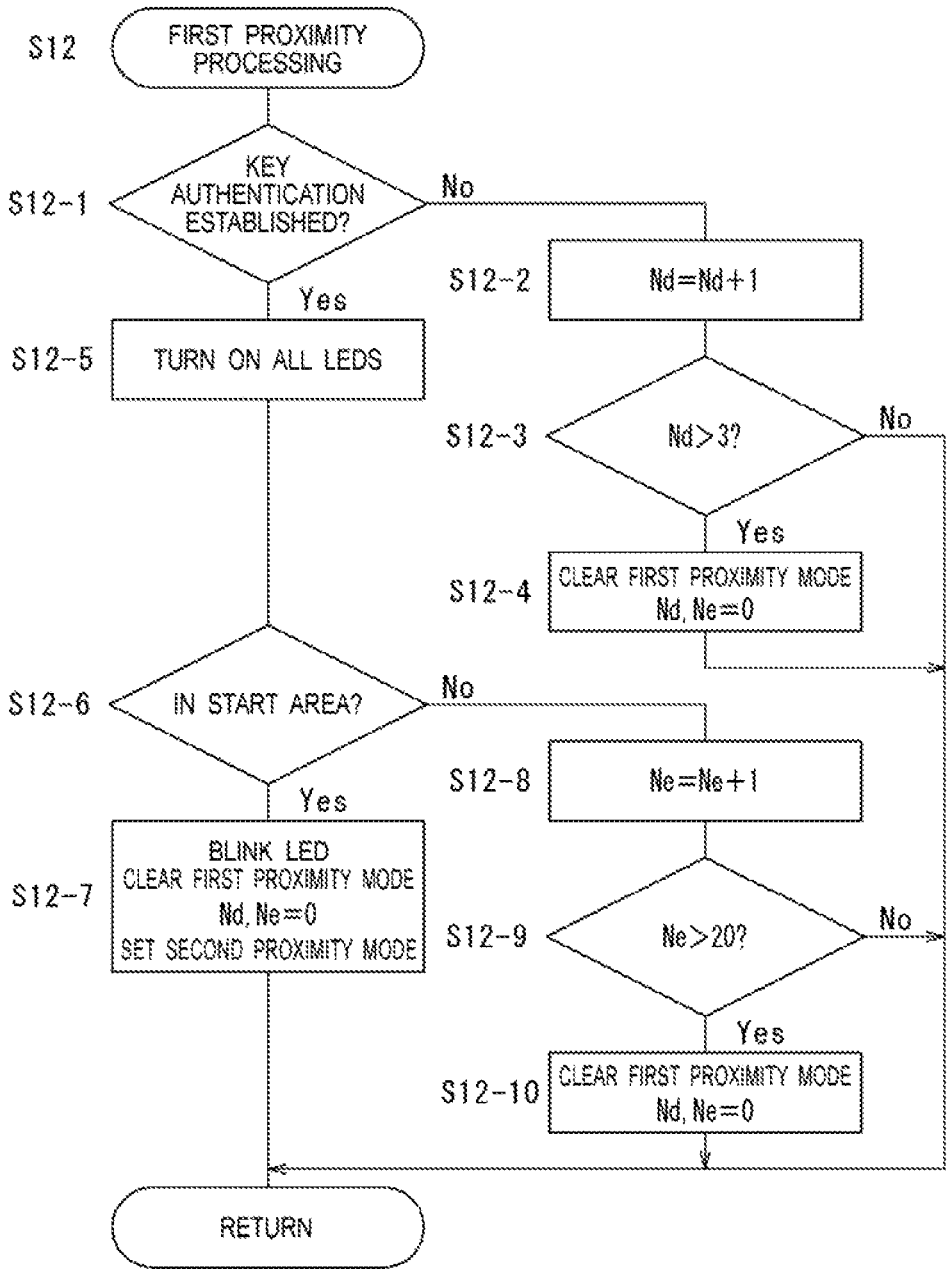
FIG. 11 is a flowchart of first proximity processing of FIG. 5B.

If set to the first proximity mode in the approach processing, the control section 32 executes the first proximity processing shown in FIG. 11. In the first proximity processing, first, whether or not the authentication in the approach processing has been established is read (step S12-1). If the authentication has not been established, 1 is added to the counter Nd (step S12-2). It is judged whether or not the counter Nd has exceeded 3 (step S12-3), and if exceeded, the first proximity mode is cleared and the counters Nd and Ne are reset (step S12-4).

If the authentication has been established (step S12-1: Yes), all the LEDs 27A to 27C are turned on (step S12-5). Thereafter, on the basis of the detection signals from the detection sensors 13A to 13D, it is judged whether the user has moved into the start area 20 of any of the three operation zones 18A to 18C or has not moved into the start area 20 of none of the three operation zones 18A to 18C (step S12-6).

If the user has moved into the start area 20 of any of the operation zones 18A to 18C (step S12-6: Yes), of the three LEDs 27A to 27C, the LED corresponding to the operation zone where the user is located is caused to blink. In addition, the processing mode is changed from the first proximity mode to the second proximity mode, and the counters Nd and Ne are reset (step S12-7).

If the user has not stopped in the start area 20 of any of the operation zones 18A to 18C (step S12-6: No), 1 is added to the counter Ne (step S12-8). If the user does not stop in the start area 20 until the counter Nd exceeds 20 (step S12-9: Yes), the first proximity mode is cleared and the counters Nd and Ne are reset (step S12-10).

Thus, in the first proximity processing, on the basis of whether or not the user has stopped in the start area 20, the control section 32 judges whether or not the opening and closing control of the door 4 may be started. Therefore, the transition from the first proximity processing to the second proximity processing can be prevented from being inadvertently executed. Furthermore, by causing, of the three LEDs 27A to 27C, the LED corresponding to the operation zone where the user is located to be displayed in a blinking manner, the location for the user to move to can be indicated in an at-a-glance manner.

(Second Proximity Processing: Step S14)

Figure 12:
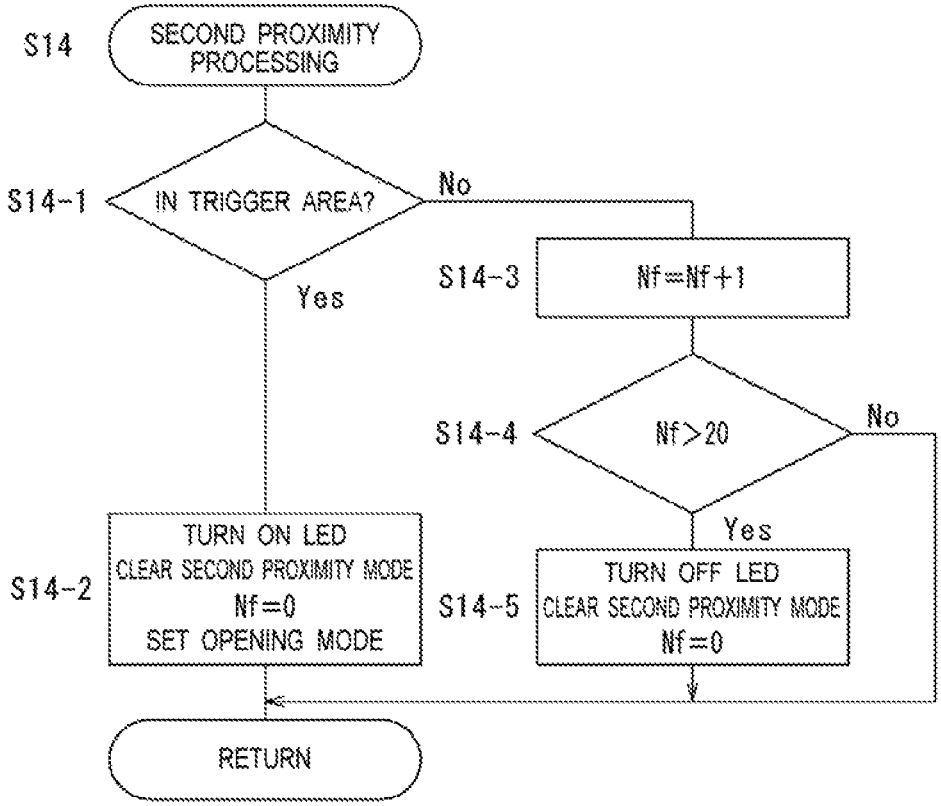
FIG. 12 is a flowchart of second proximity processing of FIG. 5B.

If set to the second proximity mode in the first proximity processing, the control section 32 executes the second proximity processing shown in FIG. 12. In the following description, the case where the user is located in the center operation zone 18B will be described as an example, but also the left and right center operation zones 18A and 18C are identical except a difference in the LEDs 27A and 27C to be displayed.

In the second proximity processing, it is first judged whether or not the user has moved into the trigger area 19 of the operation zone 18B (step S14-1).

As shown in FIG. 1B or FIG. 2B, if the user has moved into the trigger area 19 (step S14-1: Yes), the blinking LED 278 is switched to the lighted state, the processing mode is changed from the second proximity mode to the opening mode, and the counter Nf is reset (step S14-2).

If the user has not moved into the trigger area 19 (step S14-1: No), 1 is added to the counter Nf (step S14-3). If the user does not move into the trigger area 19 until the counter Nf exceeds 20 (step S14-4), the LED 27B is turned off, the second proximity mode is cleared, and the counter Nf is reset (step S14-5).

Thus, in the second proximity processing, by switching, of the three LEDs 27A to 27C, the LED 27B of the operation zone 18B where the user is located from the blinking state to the lighted state, thereby allowing the user to recognize that a part of the predetermined movement has been completed.

(Opening Processing: Step S16)

Figure 13:
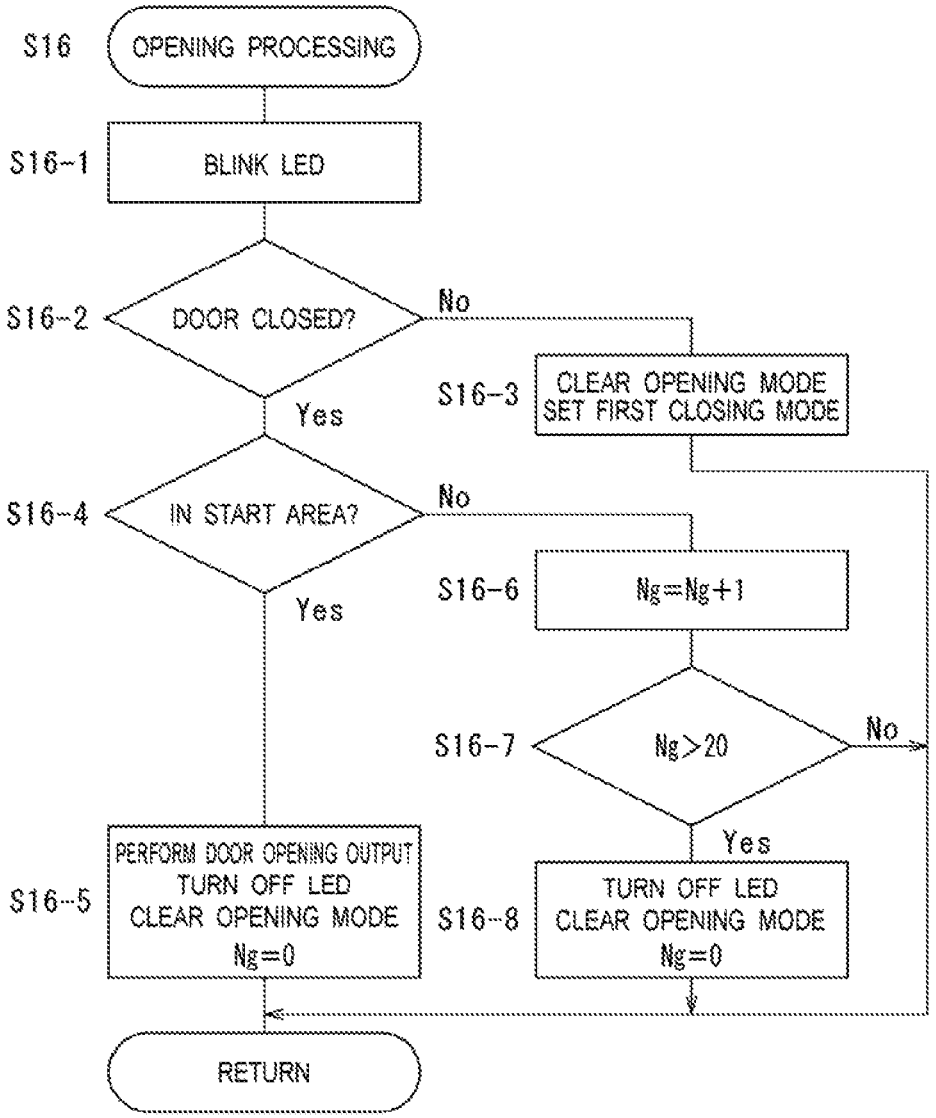
FIG. 13 is a flowchart of opening processing of FIG. 5B.

If set to the opening mode in the second proximity processing, the control section 32 executes the opening processing shown in FIG. 13. In the opening processing, the LED 27B is changed from the lighted state to the blinking state (step S16-1), and it is judged whether or not the door 4 is in the closed state (step S16-2).

If the door 4 is not in the closed state (step S16-2: No), as shown in FIG. 2A, the door 4 is in the open position, and hence the processing mode is changed from the opening mode to the first closing mode (step S16-3).

If the door 4 is in the closed state (step S16-2: Yes), it is judged whether or not the user has moved to the start area 20 (step S16-4). As shown in FIG. 1C, if the user has moved to the start area 20 (step S16-4: Yes), a door opening output that causes the door driving section 24 to open the door 4 is performed, the LED 27B is turned off, the opening mode is cleared, and the counter Ng is cleared (step S16-5).

If the user has not moved to the start area 20 (step S16-4: No), 1 is added to the counter Ng (step S16-6). If the user does not move to the start area 20 until the counter Ng exceeds 20 (step S16-7), the LED 27B is turned off, the opening mode is cleared, and the counter Ng is cleared (step S16-8).

When the user has moved to the start area 20 and the safety is confirmed in this manner, the door 4 is opened as shown in FIG. 1D. This allows the door 4 to be automatically opened smoothly and safely.

(First Closing Processing: Step S18)

Figure 14:
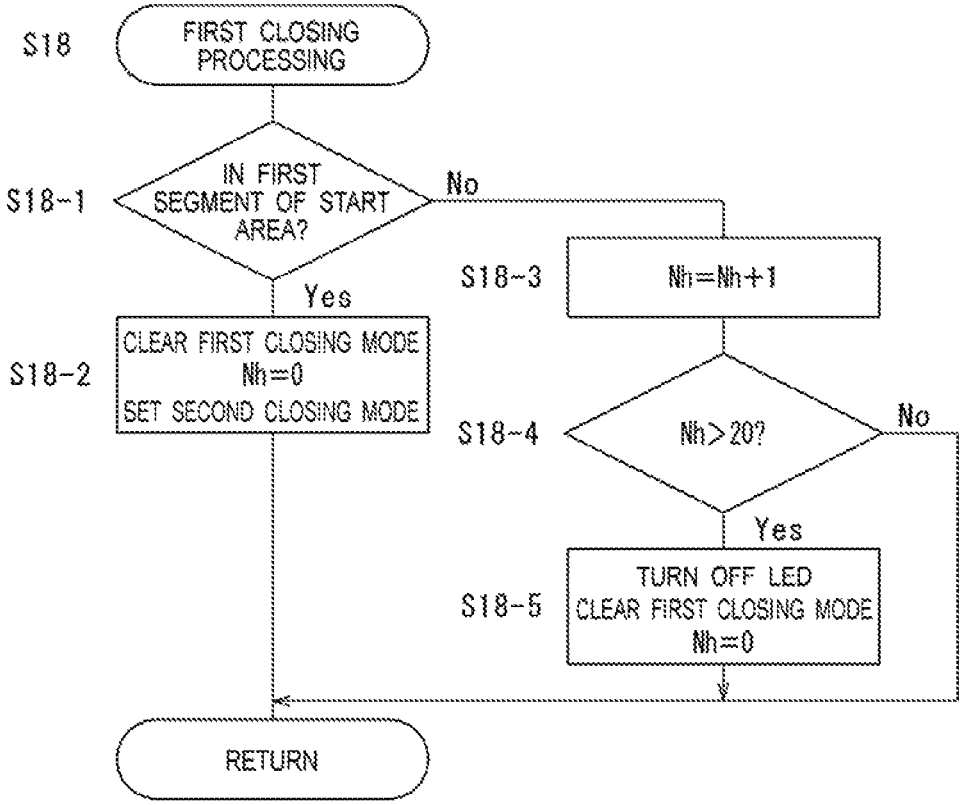
FIG. 14 is a flowchart of first closing processing of FIG. 5B.

If the door 4 is in the opened state as shown in FIG. 2A and the processing mode is set to the first closing mode in the opening processing, the control section 32 executes the first closing processing shown in FIG. 14. In the first closing processing, it is judged whether or not the user is located in the first segment 21 of the start area 20 (step S18-1). At this point of time, the LED 27B is blinking in the opening processing, thereby indicating that the user is only required to move into the start area 20.

If the user has moved to the first segment 21 of the start area 20 (step S18-1: Yes), the processing mode is changed from the first closing mode to the second closing mode, and the counter Nh is cleared (step S18-2).

If the user has not moved to the first segment 21 of the start area 20 (step S18-1: No), 1 is added to the counter Nh (step S18-3). If the user does not move into the first segment 21 until the counter Nh exceeds 20 (step S18-4), the first closing mode is cleared, the LED 27B is turned off, and the counter Nh is cleared (step S18-5).

(Second Closing Processing: Step S20)

Figure 15:
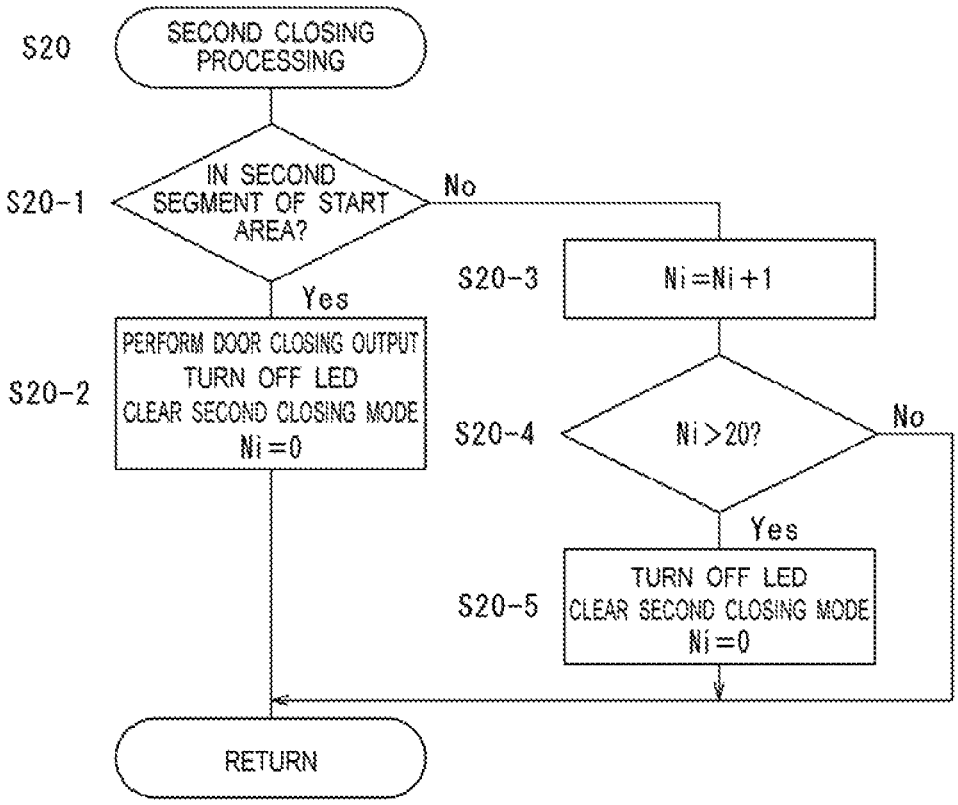
FIG. 15 is a flowchart of second closing processing of FIG. 5B.

If set to the second closing mode in the first closing processing, the control section 32 executes the second closing processing shown in FIG. 15. In the second closing processing, it is judged whether or not the user has moved from the first segment 21 to the second segment 22 of the start area 20 (step S20-1).

If the user has moved to the second segment 22 of the start area 20 (step S20-1: Yes), the door driving section 24 performs a door closing output that closes the door 4, the LED 27B is turned off, the second closing mode is cleared, and the counter Ni is cleared (step S20-2).

If the user has not moved into the start area 20 (step S18-1: No), 1 is added to the counter Ni (step S20-3). If the user does not move to the second segment 22 of the start area 20 until the counter Ni exceeds 20 (step S20-4), the second closing mode is cleared, the LED 27B is turned off, and the counter Ni is cleared (step S20-5).

Thus, in the closing processing, the door 4 is closed as shown in FIG. 2D when the user has moved from the first segment 21 to the second segment 22 of the start area 20 and the safety has been confirmed. Accordingly, the user can safely cope with the situation with a simple action without being caught in the door 4.

As described above, in the door opening and closing device 10 of the present embodiment, the user is guided by the center LED 27B in a case where the user is located in the center operation zone 18B, the user is guided by the left-side LED 27A in a case where the user is located in the left-side operation zone 18A, and the user is guided by the right-side LED 27C in a case where the user is located in the right-side operation zone 18C. Then, in the door opening and closing device 10, the door 4 can be opened or closed regardless of making the predetermined movement by any of the operation zones 18A to 18C.

That is, the user is only required to make a movement of driving the door 4 at a position where movement is easy of the three operation zones 18A to 18C formed by the detection ranges 16A to 16D of the four detection sensors 13A to 13D. Therefore, for example, in a case where movement is difficult in a specific operation zone due to a water pool or the like, it is only necessary to make a movement of driving the door 4 in another operation zone, and it is hence possible to improve user convenience.

Furthermore, in a case where the detected object is detected in each of the three operation zones 18A to 18C, the control section 32 gives priority to the detected object that has been first detected and ignores (not detects) other detected objects, and hence the detection sensors 13A to 13D do not make a false detection even if a plurality of persons are present near the door 4. Furthermore, if it is judged that the detected object detected by the priority detection sensor is an obstacle, the detection result of the obstacle is invalidated and the detected object detected next is given priority, thereby allowing control failure of the door 4 due to detection of the obstacle to be suppressed.

Moreover, as the detection unit 12 having the four detection sensors 13A to 13D, the back sonar mounted on the vehicle 1 in recent years can be used, and hence an increase in cost due to mounting of the door opening and closing device 10 can be suppressed.

(Modifications)

Figure 16:
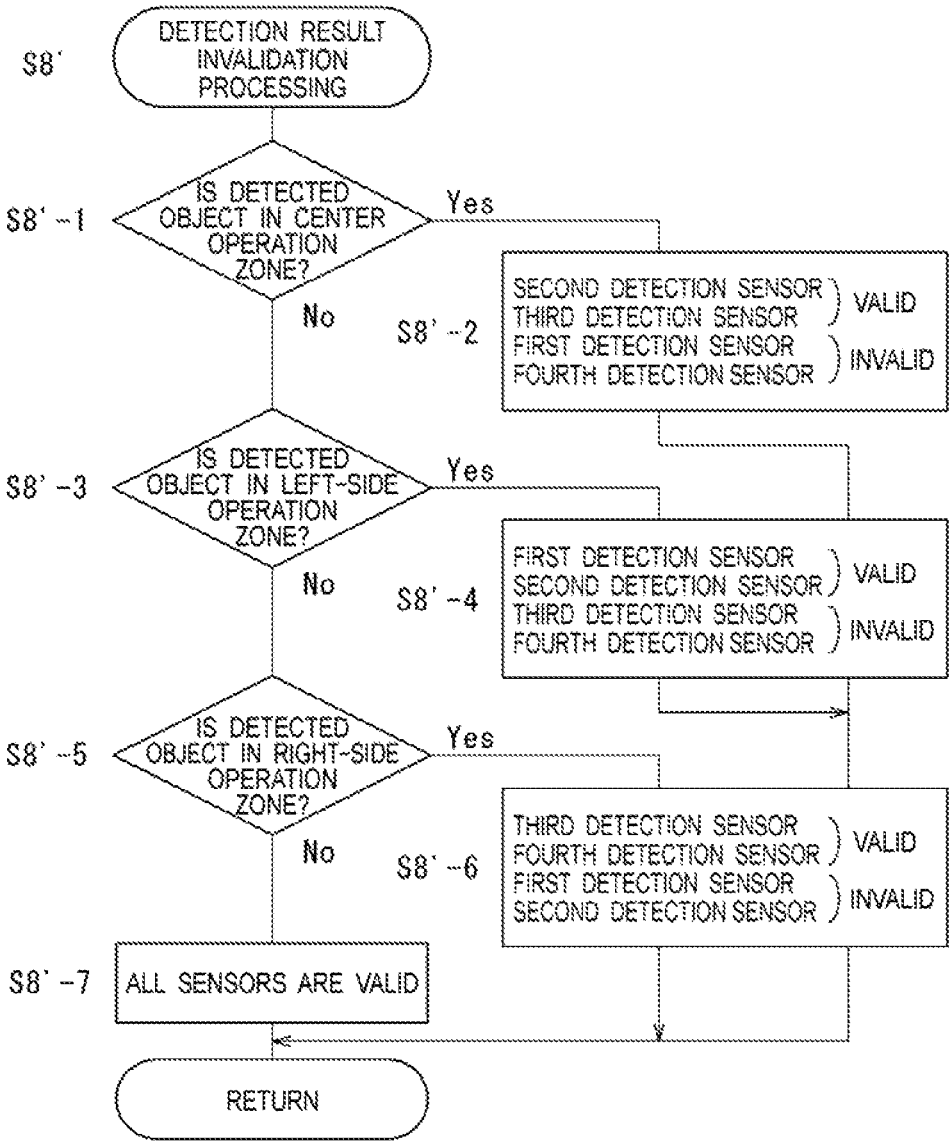
FIG. 16 is a flowchart of a modification of a method of giving priority to a detection result.

FIG. 16 shows a modification of the method of giving priority to the detection results of two detection sensors of the four detection sensors 13A to 13D over the detection results of the two other detection sensors. In this modification, in step S8 of FIG. 5A, the control section 32 executes detection result invalidation processing of FIG. 16 instead of the operation zone determination processing of FIG. 9.

In this modification, the control section 32 invalidates the detection results of the detection sensors other than the priority detection sensor of the four detection sensors 13A to 13D. The invalidation of a detection result means that transmission by the transmitter 14 and reception by the receiver 15 are performed by all the detection sensors 13A to 13D, but the detection results of the detection sensor that is not given priority is removed and is not used for detection of the movement of the detected object. That is, the transmission of step S3 and the reception of step S4 are performed by all of the four detection sensors 13A to 13D, and only the detection result that is given priority is used for detection of the movement. In addition, similarly to the above-described embodiment, the determination of the priority order is performed immediately after initialization of the control section 32, immediately after a case where none of detected object has been detected in any of the detection zones 18A to 18C.

For example, if the detected object is first detected in the operation zone 18B, the control section 32 causes all the detection sensors 13A to 13D to detect the detected object, but uses, for the detection of the movement, only the detection results of the two detection sensors 13B and 13C corresponding to the operation zone 18B, and does not use, for the detection of the movement, the detection results of the two other detection sensors 13A and 13D. If it is judged that the detected object in the operation zone 18B is an obstacle, the control section 32 uses, for the detection of the movement, only the detection results of the two detection sensors 13A and 13B corresponding to the operation zone 18A where the detected object has been second detected, and does not use, for the detection of the movement, the detection results of the two other detection sensors 13C and 13D. If it is judged that the detected object in the operation zone 18A is also an obstacle, the control section 32 uses, for the detection of the movement, only the detection results of the two detection sensors 13C and 13D corresponding to the operation zone 18C where the detected object has been third detected, and does not use, for the detection of the movement, the detection results of the two other detection sensors 13A and 13B.

Specifically, as shown in FIG. 16, in the detection result invalidation processing, first, if the zone where the detected object has been detected is the center operation zone 18B (step S8'-1: Yes), the control section 32 validates the detection results of the detection sensors 13B and 13C and invalidates the detection results of the detection sensors 13A and 13D (step S8'-2).

If the zone where the detected object has been detected is not the center operation zone 18B (step S8'-1: No) but the left-side operation zone 18A (step S8'-3: Yes), the control section 32 validates the detection results of the detection sensors 13A and 13B and invalidates the detection results of the detection sensors 13C and 13D (step S8'-4).

If the zone where the detected object has been detected is not the left-side operation zone 18A (step S8'-3: No) but the right-side operation zone 18C (step S8'-5: Yes), the control section 32 validates the detection results of the detection sensors 13C and 13D, and invalidates the detection results of the detection sensors 13A and 13B (step S8'-6).

If the zone where the detected object has been detected is not the right-side operation zone 188 (step S8'-5: No), i.e., if the detected object has not been detected in any of the operation zones 18A to 18C, the control section 32 validates the detection results of all the detection sensors 13A to 13D (step S8'-7).

By this operation zone determination processing (step S8), in the second proximity processing (step S14), the opening processing (step S16), the first closing processing (step S18), and the second closing processing (step S20), only the detection results of the validated pair of detection sensors 13A and 13B, 13B and 13C, or 13C and 13D are processed. In addition, if the detected object in the priority zone is an obstacle, the setting is switched such that only the detection results of the detection sensors constituting the operation zone with the next priority order are used, and, if the detected objects in all the operation zones 18A to 18C are obstacles, the priority order is reset. Therefore, in this modification, it is possible to prevent a malfunction of the door opening and closing device 10 due to the detection result of the detection sensor that is not given priority.

It is to be noted that the vehicle door opening and closing device 10 of the present invention is not limited to the configuration of the above-described embodiment, and various modifications can be made.

For example, in the detection unit 12 that detects the detected object, existing four back sonar sensors are used as the detection sections, but three or five or more dedicated ultrasonic sensors may be arranged. In addition, the detection section is not limited to an ultrasonic sensor, and, as long as the sensor can measure the distance to the detected object, modifications can be made where necessary.

The method of giving priority to the operation result of a specific operation section of the three or more operation sections is not limited to the method of stopping detection by the detection section and the method of invalidating the detection result by the detection section, and modifications can be made where necessary.

The door 3 controlled by the door opening and closing device 10 may be a hinge-type boarding door or a slide-type boarding door arranged on a side surface of the vehicle body 1.

The invention claimed is:

1. A device for opening and closing a vehicle door, the device comprising:

a door driving section configured to drive the vehicle door to open and close with respect to a vehicle body;

a detection unit having three or more detection sections configured to detect an object around the vehicle door, wherein the detection sections have respective detection ranges for the object, the detection sections are arranged on the vehicle body at intervals in a width direction of the vehicle door, and two or more operation zones are defined by partial overlapping of the respective detection ranges of the detection sections adjacent to each other; and a control section configured to sequentially conduct detections of the object for the operation zones based on changes in distances obtained from detection results of the detection sections, and cause the door driving section to control the vehicle door to open and close based on detection of a predetermined movement of the object in any of the operation zones, wherein:

the control section is configured to conduct a first process where the detection results of two of the detection sections corresponding to a first operation zone of the operation zones are used for detection of the predetermined movement of the object in preference to the detection results of one or more remaining detection sections other than the two of the detection sections corresponding to the first operation zone; and the first operation zone is one of the operation zones where the object has first been detected.

2. The device according to claim 1, wherein the control section, at the first process, is configured to cause the one or more remaining detection sections to stop detection.

3. The device according to claim 1, wherein the control section, at the first process, is configured to invalidate the detection results of the one or more remaining detection sections.

4. The device according to claim 1, wherein:

the control section includes a judgment section configured to judge whether or not the detected object is an obstacle other than a detection target;

the control section is configured to conduct a second process instead of the first process, based on judgment by the judgment section that the object having been detected by the two of the detection sections corresponding to the first operation zone is the obstacle; and at the second process, for detection of movement of the object, the control section is configured to use the detection results of two of the detection sections corresponding to a second operation zone of the operation zones where the object has been detected next to the first operation zone.

* * * * *